United States Patent [19]

Ryan et al.

[11] Patent Number: 4,892,508

[45] Date of Patent: Jan. 9, 1990

[54] SAFETY GUIDE SUPPORT FOR PIVOTING PULLEY

[76] Inventors: Robert Ryan, R.R. #1, Box 55, Richardson Rd., Ashby, Mass. 01431; Steven Webster, 21 Essex St., Newburyport, Mass. 01950; Richard Prouty, 20 Langsford St., Gloucester, Mass. 01930; Peter Rosa, 84 Wildcat La., Norwell, Mass. 02061

[21] Appl. No.: 365,380

[22] Filed: Jun. 13, 1989

[51] Int. Cl.[4] ..... F16H 7/04; B61B 12/00

[52] U.S. Cl. ..... 474/101; 105/151

[58] Field of Search ..... 474/101, 141, 144, 151; 242/85, 86.2, 129.5, 129.6, 129.62, 129.7, 129.72; 248/610, 58-65, 317, 322, 323, 324; 105/151-153

[56] References Cited

U.S. PATENT DOCUMENTS

| | | | |
|---|---|---|---|
| 1,154,879 | 9/1915 | Olson | 105/151 |
| 1,233,267 | 8/1917 | Erhard | 474/144 X |
| 3,018,738 | 1/1962 | Naud | 105/151 |
| 3,037,465 | 6/1962 | McIntyre | 105/151 |

*Primary Examiner*—Thuy M. Bui

*Attorney, Agent, or Firm*—M. Lawrence Oliverio

[57] ABSTRACT

An improved safety control mechanism for a pulley apparatus of the type comprising main support bars having at least two wheels mounted at their centers a spaced distance apart between the bars and a swing arm assembly pivotally connected to the bars at a point between the centers of the wheels, the swing arm assembly comprising a pair of arms straddling opposing surfaces of the bars and pivotally connected to the bars by a main pivot mechanism extending through complementary aligned apertures in the arms and the bars, the improvement comprising a second bolt mechanism extending through a second complementary aperture disposed in either the bars or the arms and a slot disposed in the other of the bars or the arms; the second aperture or the slot provided in the bars being disposed in the second distance between the center mountings of the wheels; the second aperture or the slot provided in the arms being aligned with the other of the second aperture or the slot provided in the bars with the arms and the bars connected by the main pivot bolt; the slot having an arcuate engagement surface which follows the pivot of the arms and engages the second bolt mechanism against detachment of the arms upon failure of the main pivot bolt; the second aperture and the slot being disposed around the complementary aligned apertures through which the main pivot bolt extends.

30 Claims, 2 Drawing Sheets

SAFETY GUIDE SUPPORT FOR PIVOTING PULLEY

BACKGROUND OF THE INVENTION

The present invention relates to safety mechanisms for use in conjunction with pulleys mounted on a cable, wire or the like and more particularly to a safety mechanism for preventing disengagement of a pulley from a cable due to failure of a main support bolt in pulleys of the pivoting arm type.

Pulleys are typically used as the vehicle for suspending heavy objects from a cable, wire, rope or the like (hereinafter generically referred to as "cable") and allowing the suspended object to be moved along the length of the cable, e.g. by pulling the object or stringing the cable at an angle relative to horizontal. The cable itself is typically strung, at least at some point along its length, at an elevated height above the ground, and the necessity for insuring that the pulley will not fail in its ability to maintain a heavy object suspended on the cable is thus critically important.

Pulleys comprising a pair of bars with roller wheels sandwiched therebetween and having support arms which are pivotally connected to the bars have been used in the past and suffer from the fact that a single operative element such as a bolt which connects the arms and the bars is subject to failure because the bolt is the sole support element between the object and the cable and is repeatedly subjected to degradative friction by virtue of the pivoting of the arms on the bolts as well as torque and stress forces exerted by the weight of the suspended object on the main pivot bolt through the arms.

It is therefore an object of the invention to provide a safety mechanism in a pulley apparatus for preventing the pulley from becoming disengaged from a cable in the event of a failure in the primary support components of the pulley.

SUMMARY OF THE INVENTION

In accordance with the invention there is provided an improved safety control mechanism for a pulley apparatus of the type comprising main support bars having at least two wheels mounted at their centers a spaced distance apart between the bars and a swing arm assembly pivotally connected to the bars at a point between the centers of the wheels, the swing arm assembly comprising a pair of arm straddling opposing surfaces of the bars and pivotally connected to the bars by a main pivot bolt mechanism extending through complementary aligned apertures in the arms and the bars, wherein the improvement comprises a second bolt mechanism extending through a second complementary aperture disposed in either the bars or the arms and a slot disposed in the other of the bars or the arms; the second aperture or the slot provided in the bars being disposed in the spaced distance between the center mountings of the wheels; the second aperture or the slot provided in the arms being aligned with the other of the second aperture or the slot provided in the bars with the arms and the bars connected by the main pivot bolt; the slot having an arcuate engagement surface which follows the pivot of the arms and engages the second bolt mechanism against detachment of the arms upon failure of the main pivot bolt; the second aperture and the slot being disposed around the complementary aligned apertures through which the main pivot bolt extends.

The slot is preferably provided in the arms and the second complementary aperture is preferably provided in the bars. The second aperture and the slot are preferably disposed above the complementary aligned apertures through which the main bolt extends.

The degree of arc of the slots and the disposition of the slots and the second apertures are preferably selected to limit pivoting of the arms to between selected maximum pivot positions.

The arcuate engagement surface of the slot typically follows the pivot of the arms according to a circle having a radius beginning at the axis of the main pivot bolt. One or both of the arms may include a protrusion extending toward the bars, the protrusion being disposed at a distal point along the length of an arm selected to limit the pivot of the arms to a selected degree relative to the bars.

DETAILED DESCRIPTION OF THE INVENTION

Following is a description of typical preferred embodiments of the invention.

Figure 1:
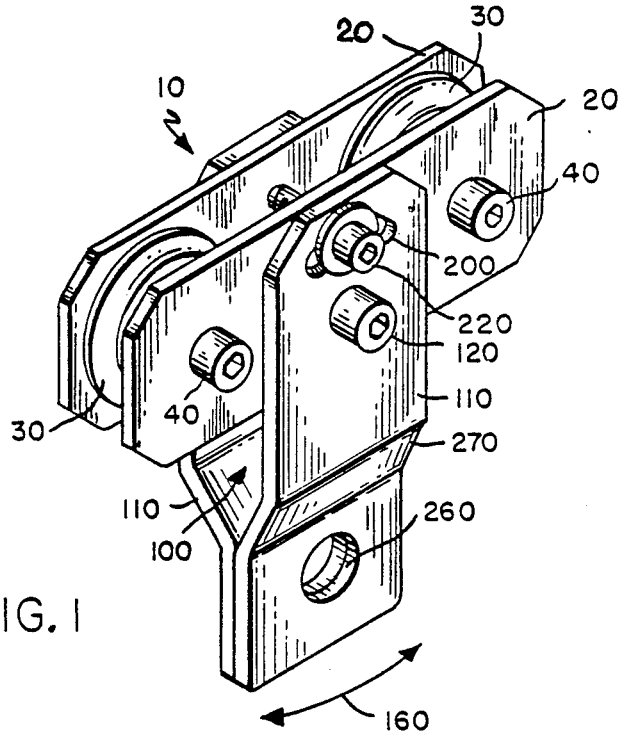
FIG. 1 is a side isometric view of a pulley of the pivoting arm type incorporating a safety guide mechanism according to the invention.
Figure 2:
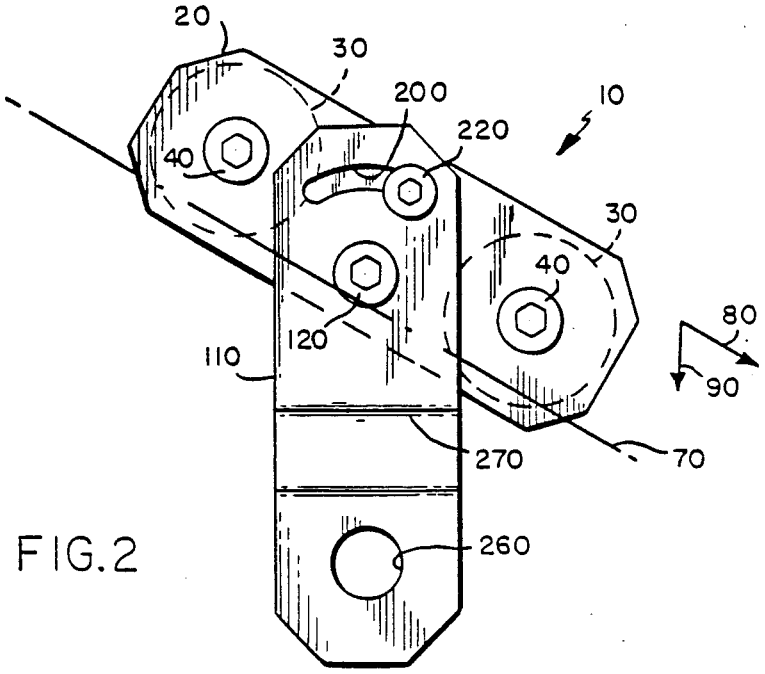
FIG. 2 is a side view of the FIG. 1 apparatus showing the of the apparatus in one maximum pivot position.
Figure 3:
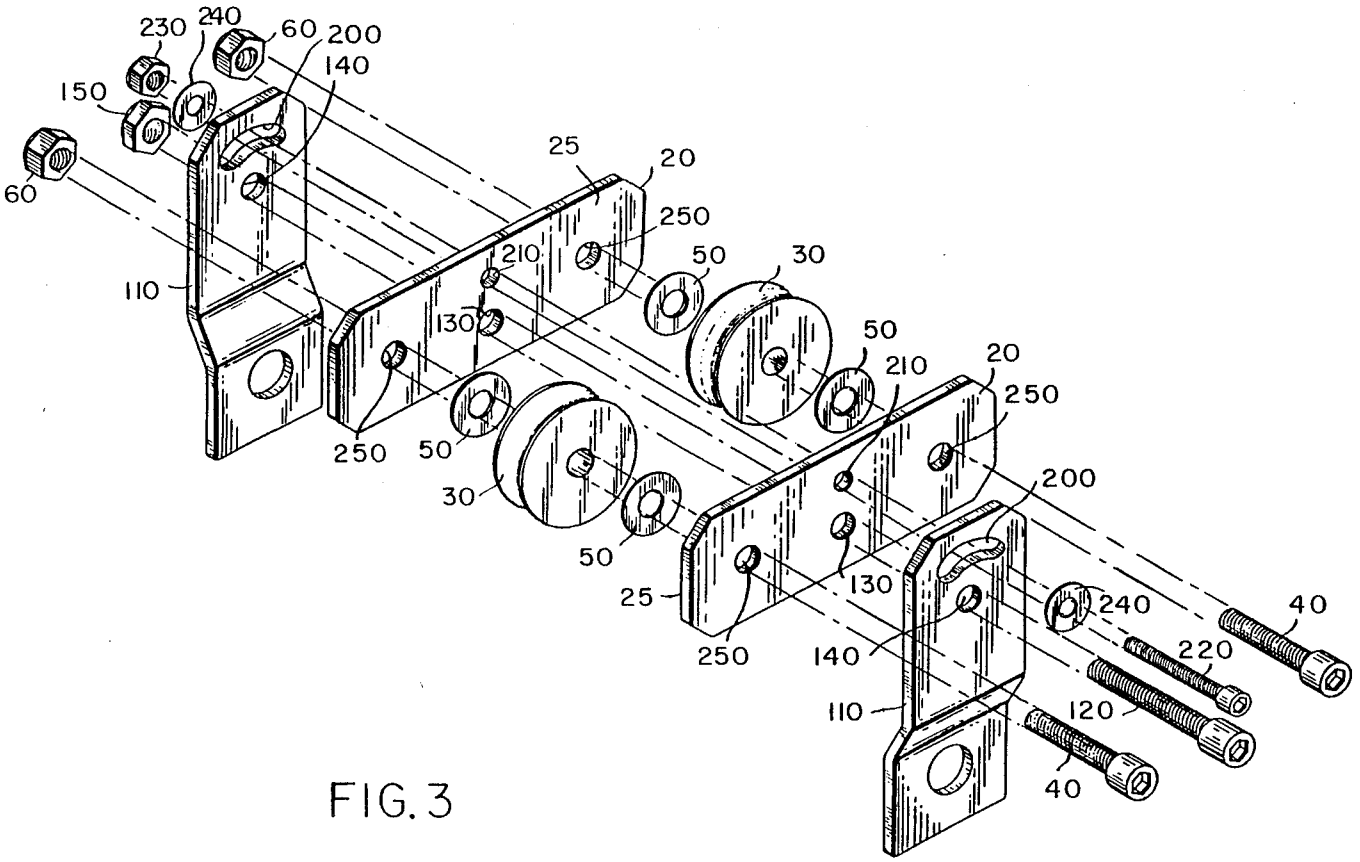
FIG. 3 is an exploded side isometric view of the FIG. 1 apparatus.

As shown in FIGS. 1-3, a typical pivoting pulley 10 comprises a pair of opposing main support bars 20 between which are sandwiched grooved wheels 30. The wheels 30 are mounted to the bars 20 by bolts 40 which extend through the bars 20 and the centers of the wheels 30. Washers 50 are typically provided on either side of wheels 30 and nuts 60 ar provided such that wheels 30, bars 20, bolts 40 and nuts 60 may be assembled into a substructure with wheels 30 spaced from the inside surfaces 25 of the bars 20 by the width of the washers 50. Wheels 30 are typically provided with sealed ball bearings such that the wheels 30 are freely rotatable once assembled together with bars 20, bolts 40, washers 50 and nuts 60 regardless of the degree of tightening of nuts 60 on bolts 40.

As shown in FIGS. 1, 3, wheels 30 are provided with a circumferential groove for purposes of receiving a cable 70 in a manner such as shown in FIG. 2 whereby the underside circumference of the wheels 30 receives the cable 70 in a tangential relationship to the circumference of the grooves within the wheels 30. As can be readily imagined, if a cable 70 is disposed such as shown in FIG. 2, the force of gravity will create a downward force 90 (by virtue of the weight of the device 10 and any object attached thereto) on the cable 70 which in turn will create a frictional force between the surface of the grooves in wheels 30 and the cable 70. Thus the wheels 30 will be caused to roll along the cable 70 in the direction 80. The freely rotatable nature of the wheels 30 will thus allow the device 10 and anything attached thereto to freely roll along the cable 70 under a pulling force vector parallel to the cable.

Regardless of the specific orientation of the cable on which the device 10 is mounted, the cable is routed through the space 100 between opposing arms 110, between opposing bars 20 and into the grooves provided on the wheels 30. As shown in FIGS. 1–3, the wheels are mounted on the bars 20 such that the centers of the wheels 30 are spaced a certain distance apart from each other along the length of the support bars 20. A pair of opposing arms 110 are pivotally connected to the bars 20 by means of a main pivot support bolt 120 which extends through a pivot aperture 130 (disposed between the central mounting apertures 250 provided for the wheels 30) and pivot apertures 140 provided in arms 110.

As shown in FIG. 3, apertures 130, 140 are appropriately aligned such that when nut 150 is secured on bolt 120 the arms 110 are assembled together with the remaining elements of the device 10 as shown in FIG. 1 with the arms 110 being pivotably connected to the bars 20 between wheels 30. Once the arms 110 are so connected, they are pivotable in the directions 160, FIG. 1, relative to the axis of bars 20 (as defined by a line between the centers of wheels 30) and any cable, such as 70, on which the wheels 30 are mounted.

As shown in FIGS. 1–3, the opposing arms 110 straddle the outside surfaces of the bars 20 and curved slots 200 are provided in the arms 110 above the main pivot apertures 140. Apertures 210 are provided in bars 20 and are aligned with the slots 200 such that a safety bolt 220 may be inserted therethrough and extend through arms 110 and bars 20. Upon assembly, the nut 230 is screwed onto the end of bolt 220 and washers 240 are typically also provided in the arrangement as shown in FIGS. 1–3.

The apertures 210 are disposed in the bars between the center mounting apertures 250 for the wheels 30. In an alternative embodiment, the slots 200 may be provided in the bars 20 and the apertures 210 may be provided in the arms such that when the arms 110 pivot about bolt 120, safety bolt 220 will be driven back and forth through slots in the bars along an arcuate path. In either such embodiment the inside surfaces of the slots 200 and apertures 140 combine to engage bolt 220 in the event bolt 120 should fail and thus prevent arms 110 from detaching from bars 20 in the event of such a failure.

The profile of slots 200 is most preferably selected to follow the pivot path of the portion of arm 110 which corresponds to the location or disposition of apertures 210 in either the bars 20 or arms 110. Typically the profile of the engagement surfaces of the slots 200, i.e. the upper surfaces of the slots 200 if the slots are disposed in the arms 110 and the lower surfaces of the slots 200 if disposed in the bars 20, is selected to be circularly arcuate so as to closely follow the normally circular pivot path of the portion of the arms 110 which correspond to the apertures 210. In normal operation where the main pivot bolt 120 is still intact, the inside surfaces of the slots 200 are machined such that safety bolt 220 will not engage the inside surfaces of the slots 200 during pivoting in order to preserve the structural integrity of the bolt 220 during normal operation. As can be readily imagined, in normal operation, the pulley 10 is mounted on a cable, such as 70, FIG. 2, and an object, typically a heavy object, is suspended from a lower distal end of the arm 110 by attaching the object to the arms 110 by conventional means such as by attachment of a carabiner clip through an aperture 260 provided in arms 110. Thus in normal operation, the main pivot bolt 120 bears the entire weight of the suspended object and arms 110 against detachment from bars 20 as well as being subjected to torque stresses caused by the pivoting of arms 110 and the consequent pivoting of inside surfaces of apertures 140, 130 on bolt 120.

In the event of failure of bolt 120, safety bolt 220 will engage the inside surfaces of slots 200 and the inside surfaces of apertures 210 thus preventing the suspended object from falling.

As shown in FIGS. 1–3 the slots 200 and apertures 210 are typically disposed above the main pivot apertures 130, 140. In alternative embodiments, the slots 200 and apertures 210 may be disposed below apertures 130, 140 and may also be disposed laterally relative to apertures 130, 140, i.e. in any position 360° around the axes of apertures 130, 140. Most preferably, the slots 200 and apertures 210 are disposed generally above or below apertures 130, 140 so as to minimize twisting of the device 10 upon failure of bolt 120.

As shown in FIGS. 1–3 the slots 200 are preferably machined to limit the degree of arcuate pivot travel of the arms 110, typically to between about 15 and about 130 degrees relative to the axis of the bars 20. For example, as best shown in FIG. 2, the arms 110 are shown in an approximately 45 degree pivot position (relative to the axis of the bars 20 as defined by the centers of the wheels 30) and are prevented from any further pivoting in the direction shown by virtue of engagement of bolt 220 with the limiting end of slots 200. In most applications, the cable on which the device 10 is suspended, is strung at an angle of between 0 and about 75 degrees relative to the ground. The total maximum degree of pivot necessary for the arms relative to the axis defined by the center of the wheels 30 is therefore at least about double the angle at which the cable is strung relative to horizontal. For example, with respect to FIG. 2, the cable 70 is strung at about 45 degrees relative to horizontal and the total maximum degree of pivot provided for by slots 200 is at least about 90 degrees. It is noted however, that even where a cable is strung at 0 degrees relative to horizontal, the arms 110 are provided with a fair degree of maximum pivot, e.g. up to 90°, to allow for pulling of the suspended object horizontally which will result in a fair degree of pivoting of the arms 110.

The maximum degree of arm 110 pivoting may also be limited by providing the arms with an interference protrusion such as a bend 270 at a distal portion of an arm 110. As shown in FIG. 2, the inward bend 270 interferes with the underside of bar 20 at about the 45° arm 110 pivot shown in FIG. 2 and thus prevents any further pivoting in the direction shown.

With respect to the attachment of nuts 230 and 150 to bolts 220 and 120 respectively, a mechanism is typically provided to insure that the nuts 230, 150 remain secured to the ends of bolts 220, 120 such as by providing a cotter pin inserted through a bolt 220, 120, a plastic bushing inserted between the threads of the bolts 220, 120 and the nuts 230, 150 or the like. The nuts 230 150 are typically screwed onto the ends of bolts 220, 120 only so far as is necessary to secure bolts 220, 120 from exiting apertures 210, slots 200 and apertures 130, 140. The nuts 230, 150 are preferably not screwed so far onto bolts 220, 120 as to cause the heads of the bolts 220, 120 and the nuts 230, 150 to engage the outside surfaces of arms 110 under substantial pressure in order to more readily allow the arms 110 to pivot and preserve the integrity of the outside surfaces of the arms 110.

As shown in FIGS. 1–3, the arms 110 straddle the outside surfaces of the bars 20. In an alternative embodiment the arms 110 could straddle the inside surfaces of the bars 20 with the proviso that the wheels 30 be spaced apart a distance sufficient so as not to interfere with the arms 110 during pivoting action.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. An improved safety control mechanism for a pulley apparatus of the type comprising main support bars having at least two wheels mounted at their centers a spaced distance apart between the bars and a swing arm assembly pivotally connected to the bars at a point between the centers of the wheels, the swing arm assembly comprising a pair of arms straddling opposing surfaces of the bars and pivotally connected to the bars by a main pivot bolt mechanism extending through complementary aligned apertures in the arms and the bars, wherein the improvement comprises:

a second bolt mechanism extending through a second complementary aperture disposed in either the bars or the arms and a slot disposed in the other of the bars or the arms;

the second aperture or the slot provided in the bars being disposed in the spaced distance between the center mountings of the wheels;

the second aperture or the slot provided in the arms being aligned with the other of the second aperture or the slot provided in the bars with the arms and the bars connected by the main pivot bolt;

the slot having an arcuate engagement surface which follows the pivot of the arms and engages the second bolt mechanism against detachment of the arms upon failure of the main pivot bolt;

the second aperture and the slot being disposed around the complementary aligned apertures through which the main pivot bolt extends.

2. The mechanism of claim 1 wherein the slot is provided in the arms and the second complementary aperture is provided in the bars.

3. The mechanism of claim 1 wherein the second aperture and the slot ar above the complementary aligned apertures through which the main bolt extends.

4. The mechanism of claim 3 wherein the degree of arc of the slots and the disposition of the slots and the second apertures are selected to limit pivoting of the arms to between selected maximum pivot positions.

5. The mechanism of claim 2 wherein the second aperture and the slot are above the complementary aligned apertures through which the main bolt extends.

6. The mechanism of claim 2 wherein the degree of arc of the slots and the disposition of the slots and the second apertures are selected to limit pivoting of the arms to between selected maximum pivot positions.

7. The mechanism of claim 5 wherein one or both of the arms include a protrusion extending toward the bars, the protrusion being disposed at a distal point along the length of an arm selected to limit the pivot of the arms to a selected degree gelative to the bars.

8. The mechanism of claim 5 wherein the degree of arc of the slots and the disposition of the slots and the second apertures are selected to limit pivoting of the arms to between selected, maximum pivot positions.

9. The mechanism of claim 8 wherein the arcuate engagement surface of the slot follows the pivot of the arms according to a circle having a radius beginning at the axis of the main pivot bolt.

10. The mechanism of claim 9 wherein one or both of the arms include a protrusion extending toward the bars, the protrusion being disposed at a distal point along the length of an arm selected to limit the pivot of the arms to a selected degree relative to the bars.

11. The mechanism of claim 8 wherein one or both of the arms include a protrusion extending toward the bars, the protrusion being disposed at a distal point along the length of an arm selected to limit the pivot of the arms to a selected degree relative to the bars.

12. The mechanism of claim 5 wherein the arcuate engagement surface of the slot follows the pivot of the arms according to a circle having a radius beginning at the axis of the main pivot bolt.

13. The mechanism of claim 1 wherein the degree of arc of the slots and the disposition of the slots and the second apertures are selected to limit pivoting of the arms to between selected maximum pivot positions.

14. The mechanism of claim 1 wherein the arcuate engagement surface of the slot follows the pivot of the arms according to a circle having a radius beginning at the axis of the main pivot bolt.

15. The mechanism of claim 1 wherein one or both of the arms include a protrusion extending toward the bars, the protrusion being disposed at a distal point along the length of an arm selected to limit the pivot of the arms to a selected degree relative to the bars.

16. An improved safety control mechanism for a pulley apparatus of the type comprising main support bars having at least two wheels mounted at their centers a spaced distance apart between the bars and a swing arm assembly pivotally connected to the bars at a point between the centers of the wheels, the swing arm assembly comprising a pair of arms straddling opposing surfaces of the bars and pivotally connected to the bars by a main pivot bolt mechanism extending through complementary aligned apertures in the arms and the bars, wherein the improvement comprises:

a second bolt mechanism extending through a second complementary aperture disposed in either the bars or the arms and a slot disposed in the other of the bars or the arms;

the second aperture or the slot provided in the bars being disposed in the spaced distance between the center mountings of the wheels;

the wheels being mounted to the bars by wheel support bolts extending through the bars and the centers of the wheels;

the second aperture or the slot provided in the arms being aligned with the other of the second aperture or the slot provided in the bars;

the second aperture and the slot being disposed around the complementary aligned apertures through which the main pivot bolt extends; and means for limiting the maximum degree of pivot of the arms relative to the bars.

17. The mechanism of claim 16 wherein the slot is provided in the arms and the second complementary aperture is provided in the bars.

18. The apparatus of claim 17 wherein the slots have an arcuate engagement surface which follows the pivot of the arms according to a circle having a radius beginning at the axis of the main pivot bolt.

19. The mechanism of claim 17 wherein the second aperture and the slot are above the complementary aligned apertures through which the main bolt extends.

20. The apparatus of claim 17 wherein the slots have an arcuate engagement surface which follows the pivot of the arms according to a circle having a radius beginning at the axis of the main pivot bolt.

21. The mechanism of claim 20 wherein one or both of the arms include a protrusion extending toward the bars, the protrusion being disposed at a distal point along the length of an arm selected to limit the pivot of the arms to a selected degree relative to the bars.

22. The mechanism of claim 20 wherein the degree of arc of the slots and the positioning of the slots and second apertures are selected to limit the degree of pivoting of the arms to between selected maximum pivot positions.

23. The mechanism of claim 22 wherein one or both of the arms include a protrusion extending toward the bars, the protrusion being disposed at a distal point along the length of an arm selected to limit the pivot of the arms to a selected degree relative to the bars.

24. The mechanism of claim 19 wherein the degree of arc of the slots and the positioning of the slots and second apertures are selected to limit the degree of the pivoting of the arms to between selected maximum pivot positions.

25. The mechanism of claim 19 wherein one or both of the arms include a protrusion extending toward the bars, the protrusion being disposed at a distal point along the length of an arm selected to limit the pivot of the arms to a selected degree relative to the bars.

26. The mechanism of claim 16 wherein the second aperture and the slot ar above the complementary aligned apertures through which the main bolt extends.

27. The apparatus of claim 26 wherein the slots have an arcuate engagement surface which follows the pivot of the arms according to a circle having a radius beginning at the axis of the main, pivot bolt.

28. The mechanism of claim 16 wherein the slots have an arcuate engagement surface which follows the pivot of the arms according to a circle having a radius beginning at the axis of the main pivot bolt.

29. The mechanism of claim 16 wherein the degree of arc of the slots and the positioning of the slots and second apertures are selected to limit the degree of pivoting of the arms between selected maximum pivot positions.

30. The mechanism of claim 16 wherein one or both of the arms include a protrusion extending toward the bars, the protrusion being disposed at a distal point along the length of an arm selected to limit the pivot of the arms to a selected degree relative to the bars.

* * * * *